US005857226A

United States Patent [19]

Sommer

[11] Patent Number: 5,857,226

[45] Date of Patent: Jan. 12, 1999

[54] AMPHIBIOUS CHAIR WITH ADJUSTABLE DEPTH POSITIONING

[76] Inventor: Daniel A. Sommer, 1804 N. 11th Ave. B, Pensacola, Fla. 32503

[21] Appl. No.: 984,514

[22] Filed: Dec. 3, 1997

[51] Int. Cl.[6] ..... E04N 3/18; A47K 3/12

[52] U.S. Cl. ..... 4/496; 4/579; 297/254

[58] Field of Search ..... 4/496, 579, 578.1; 297/254, 256.11

[56] References Cited

U.S. PATENT DOCUMENTS

| | | | |
|---|---|---|---|
| 1,371,715 | 3/1921 | West | 4/579 |
| 2,142,263 | 1/1939 | Bentz | 4/579 |
| 4,215,900 | 8/1980 | Coult | 297/254 |
| 4,893,363 | 1/1990 | Huff | 4/496 |
| 4,903,926 | 2/1990 | McNarry et al. | 248/214 |
| 5,050,863 | 9/1991 | Yacoboski | 272/71 |
| 5,307,527 | 5/1994 | Schober | 4/496 |
| 5,333,322 | 8/1994 | Weir | 4/496 |
| 5,406,653 | 4/1995 | Todor | 4/496 |

FOREIGN PATENT DOCUMENTS

| | | | |
|---|---|---|---|
| 544131 | 1/1932 | Germany | 4/579 |
| 2119241 | 11/1983 | Germany | 4/579 |

*Primary Examiner*—Robert M. Fetsuga
*Assistant Examiner*—Tuan N. Nguyen
*Attorney, Agent, or Firm*—Joseph N. Breaux

[57] ABSTRACT

An amphibious chair having a land mode for use as a lawn chair, preferably, for pool-side seating and a water mode for use as a pool chair for in-pool seating. Moreover, when the amphibious chair is in the water mode, the depth positioning of the seat member of the amphibious chair is adjustable.

10 Claims, 3 Drawing Sheets

AMPHIBIOUS CHAIR WITH ADJUSTABLE DEPTH POSITIONING

TECHNICAL FIELD

The present invention relates to lawn and pool chairs and, more particularly, to an amphibious chair having a land mode for use as a lawn chair, preferably, for pool-side seating and a water mode for use as a pool chair for in-pool seating. Moreover, in the water mode, the depth positioning of the seat member of the amphibious chair is adjustable.

BACKGROUND OF THE INVENTION

During the summer months swimming pools provide lots of enjoyment for kids and adults, alike. A variety of pool accessories are available to allow kids and adults to float while lying down or sitting above water. However, in some instances it is desirable to just sit in the water. Typically, pools are provided with steps providing access in and out of the swimming pool. Such steps are also used as a seating means for those who desire to be cooled. However, the access in and out of the swimming pool may be blocked by a sitting pool user who wants to relax in the water. Several attempts have been made to provide a pool chair for use in the swimming pool.

For example, U.S. Pat. No. 5,406,653, by Todor, entitled "ADJUSTABLE INFLATABLY BODY CRADLE FOR USE IN WATER" discloses an elongated flexive cradle. The elongated flexive cradle comprises three adjustably inflatable head, lower back and thigh cushions. The sides of the inflatable head, lower back and thigh cushions adjustably shift longitudinally along support members.

U.S. Pat. No. 5,333,322, by Weir, entitled "ADD-ON SEAT MODULE FOR SWIMMING POOL" comprises a modular seat unit devised to be lowered into and secured to the perimeter wall at the shallow end of a swimming pool. The modular seat provides in-pool seating.

U.S. Pat. No. 5,307,527, by Schober, entitled "POOL CHAIR" discloses a pool chair capable of being partially submerged in water of a swimming pool. The pool chair comprises an upper cross member adapted to rest along the perimeter of the pool to hold the pool chair upright in the pool.

U.S. Pat. No. 5,050,863, by Yacoboski, entitled "EXERCISE CHAIR FOR USE IN SWIMMING POOL" discloses a support chair comprising an upper horizontal beam of a C-shaped frame secured to the deck adjacent the pool and the lower arm engages the side wall of the pool to be supported thereby. The seat with back support is slidably carried to the support frame for adjustment of the depth of the seat in the pool. One of the horizontal beams of the frame is of adjustable length to adjust the angle of the seat.

While each of the above chairs functions as desired, none of them provide an amphibious chair having a land mode for use as a lawn chair, preferably, for pool-side seating and a water mode for use as a pool chair for in-pool seating.

Other devices attachable to the top side of the pool are U.S. Pat. No. 4,893,363, by Huff, entitled "HANGING WALL TABLE FOR SWIMMING POOLS" and U.S. Pat. No. 4,903,926, by McNarry et al., entitled "DETACHABLE IMMERSIBLE SUPPORT FOR SUPPORTING ARTICLES IN A SWIMMING POOL."

U.S. Pat. No. 4,893,363, by Huff, entitled "HANGING WALL TABLE FOR SWIMMING POOLS" discloses a frame for a table which engages the above ground pool wall by a J-shaped hanging support and a shelf made of plastic or the like.

U.S. Pat. No. 4,903,926, by McNarry et al., entitled "DETACHABLE IMMERSIBLE SUPPORT FOR SUPPORTING ARTICLES IN A SWIMMING POOL" discloses a detachable immersible support coupled to the top of a pool wherein the detachable immersible support comprises a mooring bracket, an U-shaped frame member, an article support and a frame member spacer.

It can be readily seen that there exists the continuing need for an amphibious chair having a land mode for use as a lawn chair, preferably, for pool-side seating and a water mode for use as a pool chair for in-pool seating.

SUMMARY OF THE INVENTION

The preferred embodiment of the amphibious chair of the present invention solves the aforementioned problems in a straight forward and simple manner. What is provided is an amphibious chair having a land mode for use as a lawn chair, preferably, for pool-side seating and a water mode for use as a pool chair for in-pool seating. Moreover, in the water mode, the depth positioning of the seat member of the amphibious chair is adjustable.

The amphibious chair, of the present invention, has a land mode for providing pool-side seating and a water mode for providing in-pool seating, said amphibious chair comprises: seat support frame structure hangable from a top deck of a pool when in said water mode wherein a bottom portion of said seat support frame structure provides first and second rear leg support members; a seat member having a back support portion parallelly coupled to said seat support frame structure and a lower seat support portion perpendicularly coupled to said seat support frame structure below said back support portion; and, first and second front leg support members perpendicularly coupled said lower seat support portion wherein said first and second rear leg support members and said first and second front leg support members serves to support said seat member above the ground a predetermined distance when in the land mode.

The seat support frame structure comprises first and second L-shaped support bracket members. The first and second L-shaped support bracket members comprise first and second parallel members essentially parallel to the horizontal plane for resting along said the top deck of the pool; and third and fourth parallel members coupled perpendicular to said first member and second member, respectively.

In view of the above, it is an object of the present invention to provide an amphibious chair wherein in the water mode the depth of submersion the seat member of the amphibious chair is adjusted to accommodate the height of the users such that the head of the user can be maintained above water, as well as, accommodate the desired amount of submersion of the torso of the user. Therefore, the seat member can be adjusted such that the arms members of the amphibious chair are positioned above water or even with the water level. Thereby, the user's arms and hands can be maintained sufficiently above water so that the user can eat and drink without getting the food soaked.

Another object of the present invention is to provide an amphibious chair having a seat member which is slidably adjusted to the desired depth of submersion in the swimming pool. Moreover, the adjustable depth of submersion accommodates varying water levels in the swimming pool in relation to the top of the pool deck so that the user can be submerged in the water to a desired depth.

A further object of the present invention is to provide such an amphibious chair with two parallel telescopic frame support members aligned in the vertical plane which have coupled thereto the seat member. The seat member has coupled thereto frame support legs having a length for supporting the seat member above the ground a predetermined distance wherein the distance of the two parallel telescopic frame support members below the seat member is essentially equal to the length of the forward leg support.

It is a still further object of the present invention to provide such an amphibious chair which removably attaches to the top of the pool deck via L-shaped support brackets wherein the L-shaped brackets have coupled thereto non-skid gripping means. The non-skid gripping means allows the L-shaped bracket to remain in place without slipping so that the amphibious chair remains attached to the top side of the pool deck even when wet.

It is a still further object of the present invention to provide such an amphibious chair which is removably attached to the interior pool side surface via suction cups to provided added securing of the amphibious chair in a buoyant environment. The suction cups serve to maintain the amphibious chair in its position in the buoyant environment.

In view of the above, it is a feature of the present invention to provide an amphibious chair which is simple to use and adjust.

Another feature of the present invention is to provide an amphibious chair which is relatively structurally simple.

A further feature of the present invention is to provide an amphibious chair which is inexpensive and simple to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
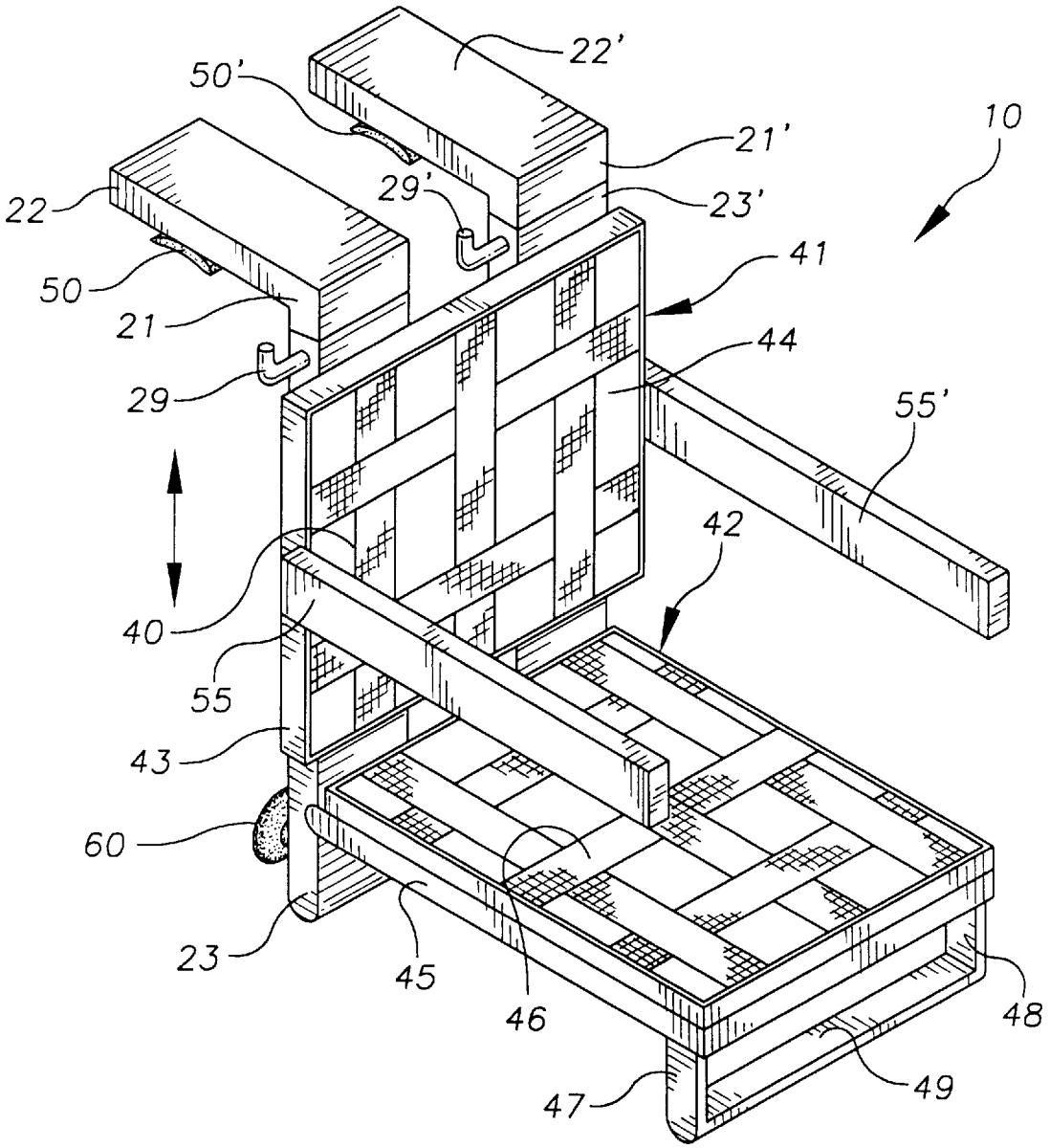
FIG. 1 illustrates a perspective view of the preferred embodiment of the amphibious chair of the present invention for use as a lawn chair or as a pool chair.
Figure 2:
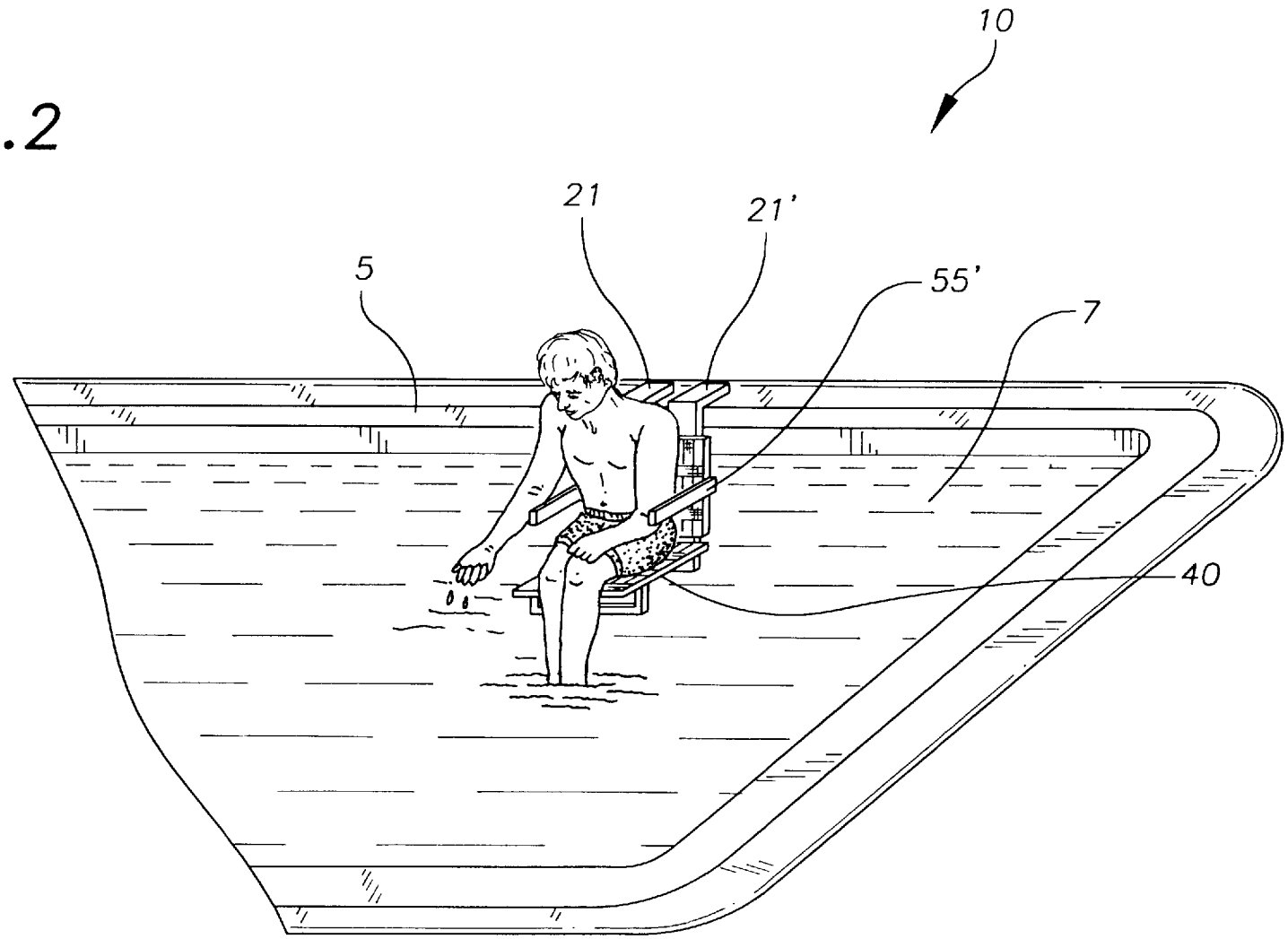
FIG. 2 illustrates a view of the amphibious chair of the embodiment of FIG. 1 submerged in the water of a swimming pool; and, FIG. 3 illustrates a perspective view of the amphibious chair of the present invention in an extended position for adjusting the depth of submersion.

Referring now to the drawings, and in particular FIGS. 1 and 2, the amphibious chair of the present invention is designated generally by the numeral 10. Amphibious chair 10 can be used on the lawn or out of water, preferably, pool-side, as a lawn chair. Additionally, amphibious chair 10 can be used as a pool chair for providing in-pool seating when in the water mode. Amphibious chair 10 is comprised or seat support frame structure 20, first and second locking/releasing members 29 and 29', seat member 40, first and second front leg members 47 and 48, first and second non-skid means 50 and 50', first and second arm support members 55 and 55', and first and second suction cup members 60 (only one shown).

Seat support frame structure 20 comprises first and second L-shaped support bracket members 21 and 21' and first and second frame extensions 27 and 27'. First and second L-shaped support bracket members 21 and 21' comprise first and second parallel members 22 and 22', respectively, essentially parallel to the horizontal plane for resting along the top deck 5 of pool 7 and third and fourth parallel member 23 and 23' perpendicularly coupled to first member 22 and second member 22', respectively.

The bottom side of first and second parallel members 22 and 22' have coupled thereto first and second non-skid means 50 and 50', respectively. First and second non-skid means 50 and 50' have surfaces which provide sufficient friction with the surface of top deck 5 to prevent slipping of first and second L-shaped support bracket members 21 and 21' when the surface of top deck 5 is wet. The first and second L-shaped support brackets 21 and 21' allow amphibious chair 10 to be easily hung from the side of pool 7 when in the water mode. Henceforth, when it is desired to use amphibious chair 10 in the lawn mode for providing a lawn chair, amphibious chair 10 is picked up from the side of pool 7.

Third and fourth parallel members 23 and 23' have coupled thereto first and second suction cup members 60 (only one shown), respectively. First and second suction cup members 60 are suction coupled to the interior perimeter wall of pool 7 to enhance the support of amphibious chair 10. In the preferred embodiment, first and second suction cup members 60 are coupled to the lower portion of third and fourth parallel members 23 and 23', respectively.

Figure 3:
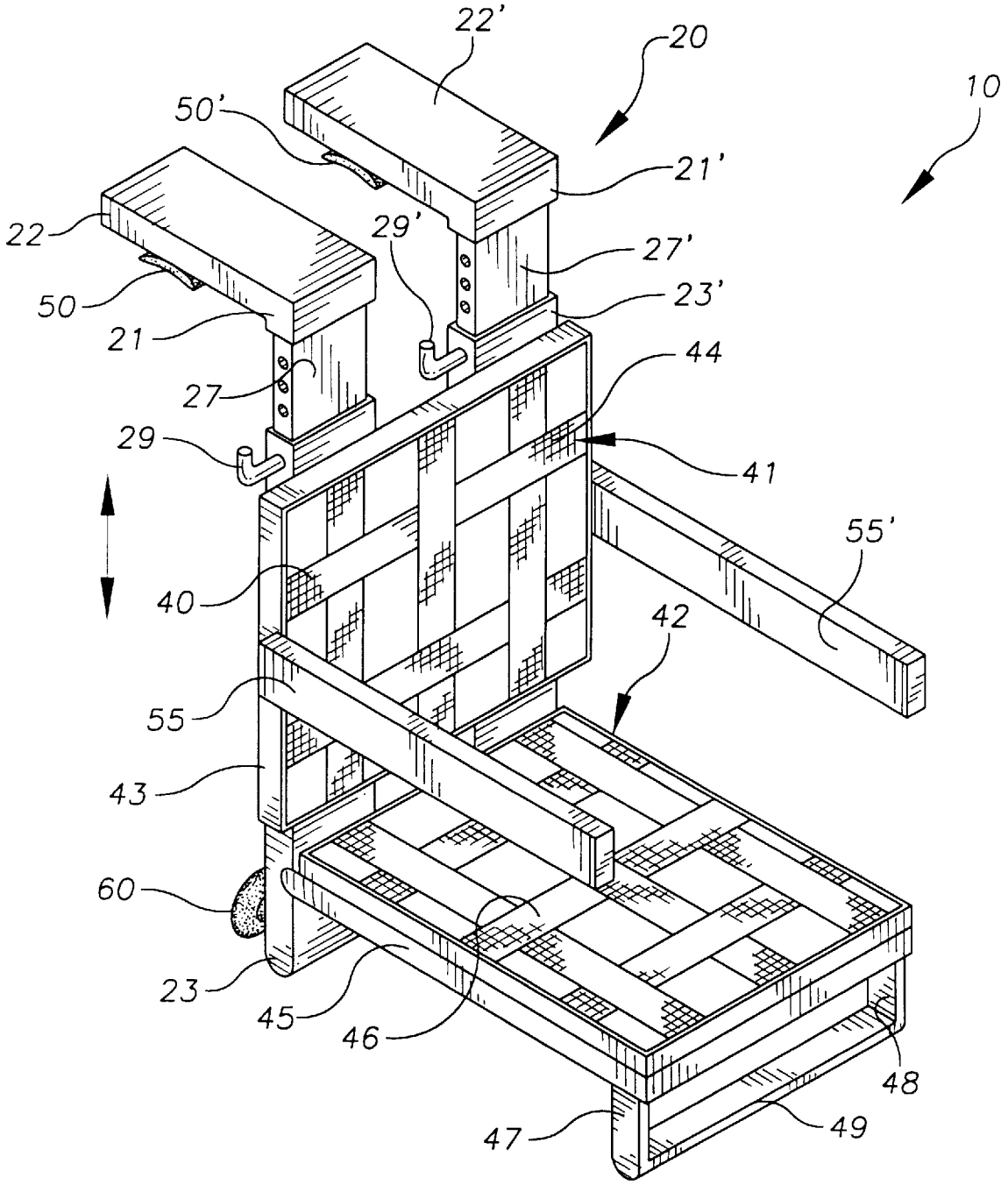

Referring to FIG. 3, third and fourth parallel members 23 and 23' are hollow for slidably receiving therein first and second frame extensions 27 and 27', respectively. First and second frame extensions 27 and 27' are perpendicularly affixed to first and second parallel members 22 and 22', respectively. Third and fourth members 23 and 23' are telescopic wherein third and fourth members 23 and 23' are slidably adjusted along the length of first and second frame extensions 27 and 27', respectively, via locking/releasing members 29 and 29', respectively.

Since third and fourth parallel members 23 and 23' are identical, only one such member will be described in detail. Third member 23 has coupled thereto locking/releasing member 29. Locking/releasing member 29 comprises a locking member receivable in one of a plurality of spaced apertures 26 formed along the length of first frame extensions 27 to lock third member 23 to a particular position along first frame extension 27. Locking/releasing member 29 also serves to release the particular position such that third member 23 can be extended to retracted to increase or decrease the depth of submersion of seat member 40.

Seat member 40 comprises back support portion 41 and lower seat support portion 42. Back support portion 41 is parallelly coupled to third and fourth parallel members 23 and 23' and lower seat support portion 42 is perpendicularly coupled to third and fourth parallel members 23 and 23' below back support portion 41. Thereby the bottom portion of third and fourth planar members 23 and 23' serve as rear leg support members.

Back support portion 41 comprises back support frame member 43 and flexible material 44 coupled to back support frame member 43. Back support frame member 43 is essentially a square or rectangular frame member having four bar member coupled together. Each of the bar members has coupled thereto flexible material 44 wherein flexible material 44 is a plurality of flexible fabric strips. Alternately, in lieu of a plurality of flexible fabric strips, netting material or other waterproof material panel may be substituted. Such flexible fabric strips are preferably woven nylon or plastic-like material which is not susceptible to deterioration even when submerged underwater for long periods of time.

Lower seat support portion 42 comprises lower support frame member 45 and flexible material 46. Lower support frame member 45 is essentially a square member having four bar members unitarily coupled together. Each of the bar members has coupled thereto flexible material 46 wherein flexible material 43 is a plurality of flexible fabric strips. Alternately, in lieu of a plurality of flexible fabric strips, netting material or other waterproof material panel may be substituted for providing back support for the user. Such flexible fabric strips are preferably woven nylon or plastic-like material.

First and second arm support members 55 and 55' have one end particularly coupled to right and left sides of back support portion 41. First and second arm support members 55 and 55' extend in the horizontal plane a predetermined distance above lower seat support portion 42.

First and second front leg members 47 and 48 are perpendicularly coupled to the front corners of lower support frame member 45 of lower seat support portion 42. First and second front leg members 47 and 48 have coupled thereto cross bar member 49. The length of first and second front leg members 47 and 48 serve to support the front end of lower seat support portion 42 above ground a predetermined distance. The length of third and fourth planar members 23 and 23' below lower seat support portion 42 have the same length as that of first and second front leg members 47 and 48, respectively. Thereby, the equal length of third fourth planar members 23 and 23' and first and second front leg members 47 and 48 below lower seat support portion 42 serve to stabilize seat member 40 on the ground when in the land mode. As can be appreciated, the equal length of third and fourth planar members 23 and 23' and first and second leg members 47 and 48 below lower seat support portion 42 allows amphibious chair 10 to serve as a lawn chair.

It is noted that the embodiment of the amphibious chair described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An amphibious chair having a land mode for providing pool-side seating and a water mode for providing in-pool seating, said amphibious chair comprising:

seat support frame structure hangable from a top deck of a pool when in said water mode and wherein a bottom portion of said seat support frame structure provides first and second rear leg support members;

a seat member having a back support portion parallelly coupled to said seat support frame structure and a lower seat support portion perpendicularly coupled to said seat support frame structure below said back support portion;

first and second front leg support members perpendicularly coupled said lower seat support portion wherein said first and second rear leg support members and said first and second front leg support members serves to support said seat member above the ground a predetermined distance when in the land mode;

said seat support frame structure comprises first and second L-shaped support bracket members wherein said first and second L-shaped support bracket members comprise:

first and second parallel members essentially parallel to the horizontal plane for resting along said the top deck of the pool, and third and fourth parallel members coupled perpendicular to said first member and second member, respectively; and first and second suction cup members wherein said first and second suction cup members are coupled to said third and fourth parallel members, respectively.

2. The amphibious chair of claim 1, wherein said third and fourth members are telescopic to adjust the depth of submersion of said seat member.

3. The amphibious chair of claim 2, wherein said third and fourth members are hollow for slidably receiving therein first and second frame extensions, respectively, wherein said first and second frame extensions are perpendicularly coupled to first and second parallel members, respectively, and wherein said third and fourth members are slidably adjusted along said first and second frame extensions.

4. The amphibious chair of claim 1, further comprising:

a first arm support member having one end perpendicularly coupled to a right side of a frame of said back support portion; and, a second arm support member having one end perpendicularly coupled to a left side of a frame of said back support portion wherein said first and second arm support members extend in the horizontal plane a predetermined distance above said lower seat support portion.

5. An amphibious chair comprising:

seat support frame structure hangable from a top deck of a pool wherein said seat support frame structure comprises first and second L-shaped support bracket members wherein said first and second L-shaped support bracket members comprise:

first and second parallel members essentially parallel to the horizontal plane for resting along said the top deck of the pool, and third and fourth parallel members coupled perpendicular to said first member and second member, respectively, and a seat member having a back support portion parallelly coupled to said third and fourth parallel members and a lower seat support portion perpendicularly coupled to said third and fourth parallel member below said back support portion;

first leg member, coupled to a first front corner of a frame of said lower seat support portion, having a first length;

a second leg member, coupled to a second front corner of the frame of said lower seat support portion, having said first length wherein a length of said third and fourth parallel members below said lower seat support portion is the same as said first length; and first and second suction cup members wherein said first and second suction cup members are coupled to said third and fourth parallel members, respectively.

6. The amphibious chair of claim 5, wherein said third and fourth members are telescopic to adjust the depth of submersion of said seat member.

7. The amphibious chair of claim 6, wherein said third and fourth members are hollow for slidably receiving therein first and second frame extensions, respectively, wherein said first and second frame extensions are perpendicularly coupled to first and second parallel members, respectively, and wherein said third and fourth members are slidably adjusted along said first and second frame extensions.

8. The amphibious chair of claim 5, further comprising:

a first arm support member having one end perpendicularly coupled to a right side of a frame of said back support portion; and, a second arm support members having one end perpendicularly coupled to a left side of a frame of said back support portion wherein said first and second arm support members extend in the horizontal plane a predetermined distance above said lower seat support portion.

9. The amphibious chair of claim 5, further comprising first and second non-skid members coupled to a bottom side of said first and second parallel members, respectively.

10. An amphibious chair having a land mode for providing pool-side seating and a water mode for providing in-pool seating, said amphibious chair comprising:

seat support frame structure hangable from a top deck of a pool when in said water mode and wherein a bottom portion of said seat support frame structure provides first and second rear leg support members and said support frame structure comprises first and second L-shaped support bracket members wherein said first and second L-shaped support bracket members comprise:

first and second parallel members essentially parallel to the horizontal plane for resting along said the top deck of the pool, and third and fourth parallel members coupled perpendicular to said first member and second member, respectively;

a seat member having a back support portion parallelly coupled to said seat support frame structure and a lower seat support portion perpendicularly coupled to said seat support frame structure below said back support portion;

first and second front leg support members perpendicularly coupled said lower seat support portion wherein said first and second rear leg support members and said first and second front leg support members serves to support said seat member above the ground a predetermined distance when in the land mode; and first and second non-skid members coupled to bottom side of said first and second parallel members, respectively.

* * * * *